US005146151A

United States Patent [19]

Korn

[11] Patent Number: 5,146,151

[45] Date of Patent: Sep. 8, 1992

[54] FLOATING VOLTAGE REFERENCE HAVING DUAL OUTPUT VOLTAGE

[75] Inventor: Thomas Korn, San Jose, Calif.

[73] Assignee: United Technologies Corporation, Hartford, Conn.

[21] Appl. No.: 844,906

[22] Filed: Mar. 2, 1992

Related U.S. Application Data

[63] Continuation of Ser. No. 535,262, Jun. 8, 1990, abandoned.

[51] Int. Cl.[5] ..... G05F 1/585

[52] U.S. Cl. ..... 323/267; 323/281; 323/314

[58] Field of Search ..... 323/267, 281, 313, 314

[56] References Cited

U.S. PATENT DOCUMENTS

| | | | |
|---|---|---|---|
| 3,617,859 | 11/1971 | Dobkin et al. | 323/4 |
| 3,898,486 | 8/1975 | Wessel et al. | 307/297 |
| 4,263,519 | 4/1981 | Schade, Jr. | 307/297 |
| 4,277,739 | 7/1981 | Priel | 323/313 |
| 4,287,439 | 9/1981 | Leuschner | 307/310 |
| 4,357,571 | 11/1982 | Roessler | 323/281 |
| 4,377,781 | 3/1983 | Tatsushi et al. | 323/299 |
| 4,506,208 | 3/1985 | Nagano | 323/314 |
| 4,673,866 | 6/1987 | Masuda | 323/313 |
| 4,833,342 | 5/1989 | Kiryu et al. | 323/313 |

FOREIGN PATENT DOCUMENTS 1534447 1/1990 U.S.S.R. .

OTHER PUBLICATIONS

"Temperature-Independent Blasing", Transistor Current Sources & Active Leads, pp. 289,296 (undated).

*Primary Examiner*—William H. Beha, Jr.
*Attorney, Agent, or Firm*—Richard H. Kosakowski

[57] ABSTRACT

A voltage reference circuit maintains two nodes at constant voltages with respect to a reference by means of a tapped divider chain in parallel with a floating voltage reference circuit, both of which feed into the output node of a single differential amplifier. The reference circuit maintains a constant voltage across the divider chain and the amplifier floats the divider up or down to maintain a node in the chain at the reference voltage.

10 Claims, 2 Drawing Sheets

FLOATING VOLTAGE REFERENCE HAVING DUAL OUTPUT VOLTAGE

This application is a continuation of application Ser. No. 07/535,262, filed Jun. 8, 1990 now abandoned.

DESCRIPTION

1. Technical Field

The field of the invention is that of bipolar integrated circuits.

2. Background Art

When it is desired to maintain two or more output voltages having a known relationship to an arbitrary reference voltage, it is customary in the art to use a voltage reference circuit together with two amplifiers, one for each of the two desired voltages. This approach uses extra area on an integrated circuit; is costly; and introduces additional error sources.

DISCLOSURE OF INVENTION

The invention relates to a circuit in which a single voltage reference and a single amplifier combine to produce two output voltages that are referenced to an input reference voltage. The circuit includes a differential amplifier responsive to a potential difference between the reference node and a divider reference node in a resistor divider chain centered on the reference voltage and having two taps for the desired output voltages. A floating voltage reference circuit maintains a constant potential across the divider chain and the amplifier pulls one end of the divider chain to maintain the center path at the reference voltage.

Other features and advantages will be apparent from the specification and claims and from the accompanying drawings which illustrate an embodiment of the invention.

BEST MODE FOR CARRYING OUT THE INVENTION

Figure 1:
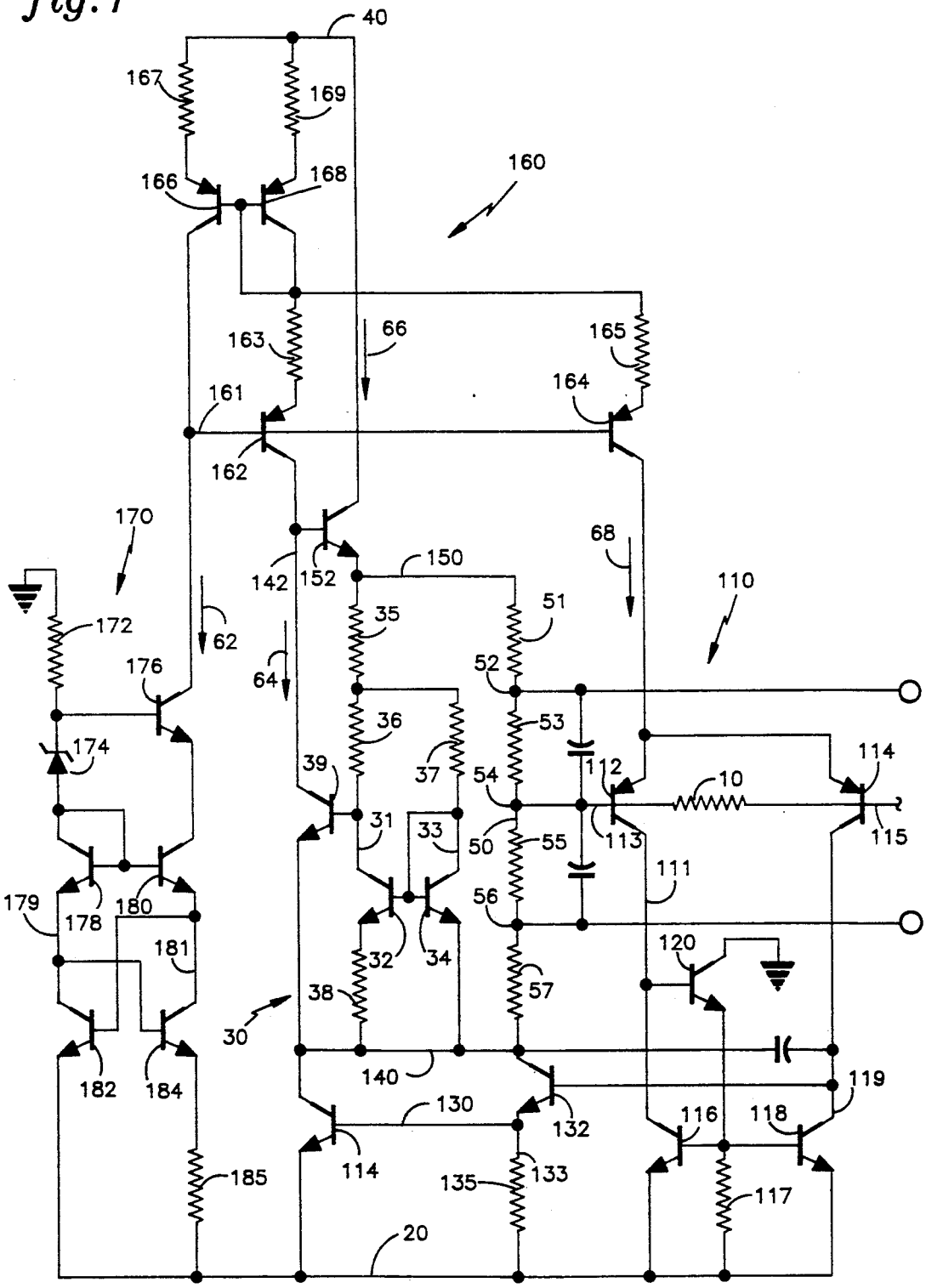
FIG. 1 illustrates an embodiment of the voltage reference circuit the present invention.
Figure 2:
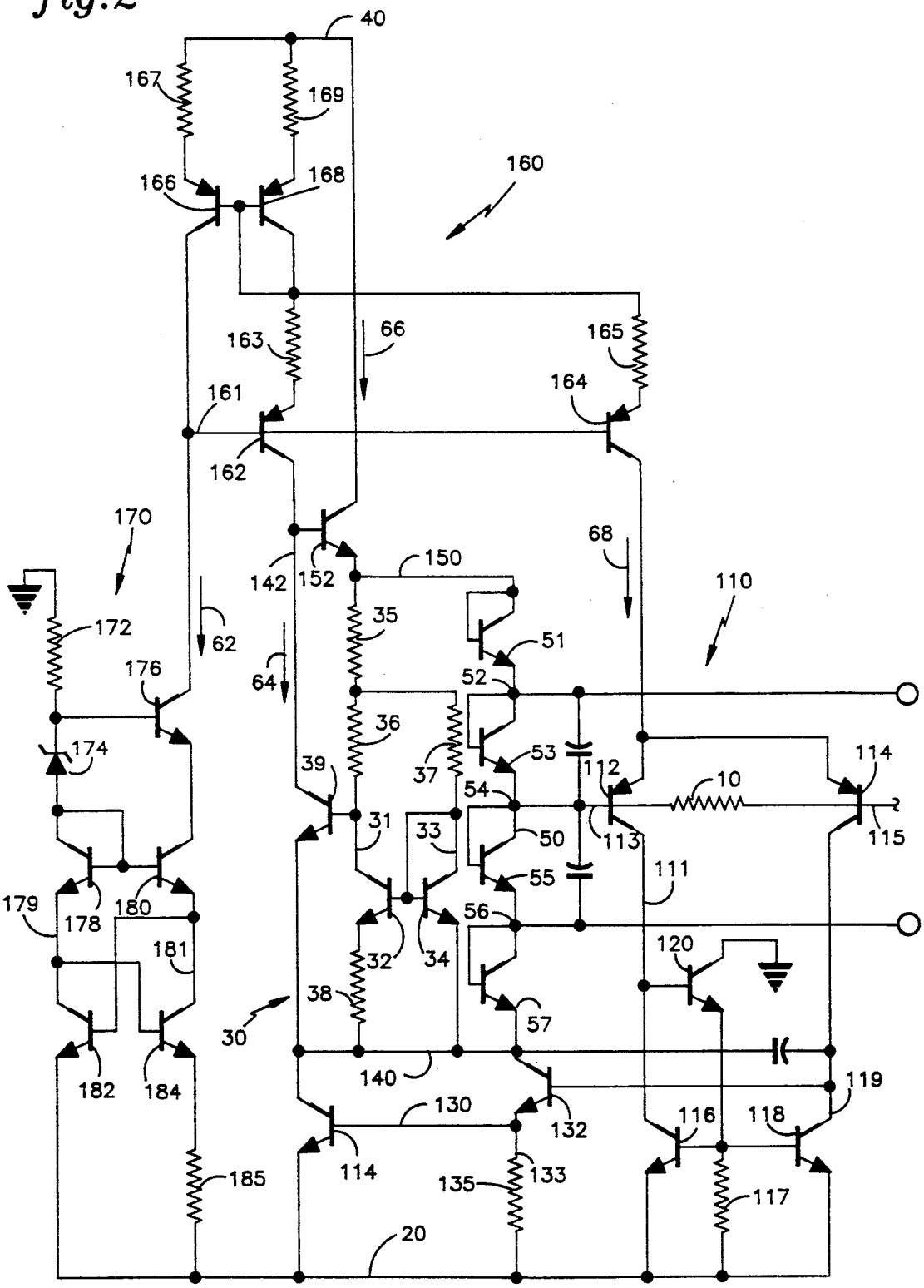
FIG. 2 illustrates an alternative embodiment of the circuit of FIG. 1.

Referring now to FIG. 1, there is illustrated a circuit embodying the invention in which nodes 52 and 56, referred to as the output terminals, of divider chain 50 are maintained at a fixed voltage relative to node 54, the divider reference terminal, which is maintained equal to a reference voltage $V_{REF}$ applied on node 115 at the right-hand side of the circuit. Current flows from upper supply voltage terminal 40 along a path indicated by the arrow labeled 66 through pull-up transistor 152, into node 150 and out of node 140, through the output portion of amplifier 110 comprising transistors 132 and 114, to lower voltage terminal 20.

In operation, node 54 will be maintained at a voltage value equal to that of a reference voltage by the operation of amplifier 110 to control node 140 in order to maintain node 54 at the correct voltage. The path from 40 breaks down into three sections: transistor 152, referred to as the current control transistor, at the top, divider chain 50, and transistor 114, referred to as the output control transistor, at the bottom.

Referring now to circuit 30 at the center of FIG. 1 it comprises a current source comprising transistors 32 and 34, resistor 38 and resistors 36 and 37. Resistor 38 and transistors 32 and 34 are chosen to form a bandgap voltage reference in a known manner to maintain the potential difference between node 140 and node 150 at the bandgap voltage of silicon. Nodes 140 and 150 are referred to as voltage reference terminals. Load resistors 36 and 37 illustratively have the same value and serve as loads for the two transistors. They are combined with resistor 35 in order to save space on the integrated circuit chip. Those skilled in the art will readily be able to apply standard techniques to maintain the nodes at a greater potential difference. Circuit 30 is referred to as a floating reference circuit because it is placed between two intermediate nodes in the total circuit, either of which may vary in voltage.

Circuit 160 at the top left of FIG. 1 maintains equal current flow through branch 64 and resistor 35, using transistors 162 and 152 as controls. Within reference circuit 30, transistor 32 is greater in area than transistor 34(four times in this embodiment). When transistor 39 carries twice as much current as each of transistors 32 and 34, the base current into transistor 39 balances that into transistors 32 and 34.

The emitter of transistor 152 is maintained at the bandgap voltage above node 140, with the collector being at the power supply value of node 40, nominally +15 volts. The emitter node 150 of transistor 152 is controlled to pass through transistor 152 an amount of current equal to that in branch 64, plus the amount drawn by resistor chain 50. Since node 142 is between two collectors, those of transistors 162 and 39, its voltage may vary over a broad range, affording it the freedom to drive the $V_{be}$ of transistor 152 as required.

If the voltage on node 140 drops, the voltage on node 54 will drop by a corresponding amount, which is sensed by the input of amplifier 110. The output of amplifier 110 will drive output circuit 130 to sink less current and thus to increase the voltage on node 140. Similarly, if the voltage on node 150 drops, the $V_{be}$ on transistor 152 will increase, pulling up node 150. Similar effects will occur if the voltage on nodes 140 or 150 change in the opposite sense from that described above.

Referring now to divider chain 50, there is a set of four resistors 51, 53, 55 and 57, separated by nodes 52, 54, and 56. The voltage on nodes 52 and 56, referred to as the output reference terminals, will be determined by the ratios of the different resistors, which are well matched in conventional integrated circuit processing, and the value of the bandgap voltage between nodes 140 and 150. If the value of a resistor in the chain varies as a function of temperature, the others will vary in the same manner to preserve an offset from the voltage on node 54 that is essentially as stable as the voltage difference between nodes 140 and 150. Since that voltage difference is independent of temperature to first order, the "window" defined by nodes 52 and 56 will be very stable.

A conventional startup and bias circuit 170 that maintains a constant current along path 62 is shown in the lower left of FIG. 1.

Returning now to the right hand side of FIG. 1, transistor 164 is controlled by node 161 and will source a current down path 68 into amplifier 110 passing through differential amplifier 110, one input of which is base 113 of transistor 112, which is connected to the control node 54. The other input terminal of amplifier 110, transistor 114, has its base 115 connected directly to the reference voltage. Resistor 10, coupling bases 113 and 115 is optional, providing improved stability. Bases 113 and 115 will be referred to as the input nodes of amplifier 110, with node 140 being the output node. With the right-hand side of the input fixed, the swings will be on the left side.

If, for example, node 54 drifts up in voltage, transistor 113, which is a PNP transistor, will start to be turned off, so that its collector node 111 will rise in voltage, turning transistor 120 harder on. This will, in turn, turn transistor 118 harder on, lowering the voltage on node 119, which controls the gate of transistor 132, so that the voltage on node 133 rises and the voltage on node 140 drops because the output load transistor 114 is turned on harder. Thus, with the voltage on node 140 dropping, the voltage on node 54 will drop again also.

Chain 50 is shown as being symmetric drawing, but those skilled art will appreciate that nodes 52 and 56 need not be symmetric about node 54. For example, they could both be on the same side of node 54. Also, the elements 51, 53, 55, 57 of the chain could be diode-wired transistors. With controllable elements consisting of a resistor paralleled by a controlled bypass transistor, 51', 51'', 51''', say in series, the voltage on node 52 could be adjusted by turning on one or more of the transistors and bypassing the corresponding resistor.

It should be understood that the invention is not limited to the particular embodiments shown and described herein, but that various changes and modifications may be made without department from the spirit and scope of this novel concept as defined by the following claims.

What is claimed is:

1. A circuit for maintaining first and second predetermined voltage values on a pair of circuit output terminals (52,54), respectively, in a known relationship with respect to an arbitrary reference voltage (115) applied to the circuit, the circuit comprising:

differential amplifier means (110), having a first input (114) connected to the reference voltage (115), and having a second input (112);

voltage divider means (50), having a plurality of series electrically connected elements (51,53,55,57), each of said elements having a voltage drop thereacross when an electrical current is passed therethrough, a first end (140) and a second end (150) of said plurality of elements each having a voltage applied thereto, said voltage divider means having a divider reference location (54) at a location within said series electrically connected elements, said divider reference location (54) being connected to said second input (112) of said differential amplifier means, each of said pair of circuit output terminals (52,54) being located at a predetermined location within said plurality of elements;

floating reference means (30), for maintaining a predetermined constant voltage between said first end (140) of said plurality of elements and said second end (150) of said plurality of elements; and wherein said differential amplifier means (110) comprises means, responsive to said reference voltage (115) and a voltage at said divider reference location (54), for maintaining a constant voltage at said divider reference location (54) in the event of a change in the voltage value applied at either said first end (140) or said second end (150), or in the event of a change in the voltage value at said divider reference location (54), said voltage changes being caused in part by a change in the parametric value of one or more elements in said plurality of elements, said change in voltage value being an asymmetric change when it occurs only at either said first end (140) or said second end (150).

2. The circuit of claim 1, further comprising:

output control means (130), responsive to an output of said differential amplifier means (110), for maintaining said divider reference location (54) at said constant voltage.

3. The circuit of claim 1, wherein said floating reference means (30) includes current source means (32,34,36,37,38).

4. The circuit of claim 3, wherein said predetermined constant voltage between said ends (140,150) is equal to the bandgap voltage of silicon.

5. The circuit of claim 1, wherein said voltage divider means comprises a series connection of resistor elements each having a predetermined fixed value.

6. The circuit of claim 1, wherein said voltage divider means comprises a series connection of diode connected transistors.

7. The circuit of claim 1, wherein said divider reference location (54) is at a center of said series connection of a plurality of elements, said plurality of elements being located in a symmetric manner about said divider reference location (54).

8. The circuit of claim 1, wherein said divider reference location (54) is at a location other than the center of said series connection of a plurality of elements, said plurality of elements being located in an asymmetric manner about said divider reference location (54).

9. The circuit of claim 1, wherein said pair of circuit output terminals (52,54) are located symmetrically on each side of said divider reference location (54).

10. The circuit of claim 1, wherein said pair of circuit output terminals (52,54) are located asymmetrically with regard to said divider reference location (54).

* * * * *